US005579698A

United States Patent [19]

Lis et al.

[11] Patent Number: 5,579,698

[45] Date of Patent: Dec. 3, 1996

[54] TRANSPORTATION AND INSTALLATION DEVICE FOR HEAVY PIPES

[76] Inventors: Henry Lis, 3 Eagles Nest Court,, Bolton, Ontario, Canada, L7E 5R8; Michael P. McNally, R.R. #1, Freelton, Ontario, Canada, L0R 1K0

[21] Appl. No.: 562,808

[22] Filed: Nov. 27, 1995

[51] Int. Cl.[6] ..... B61D 11/02

[52] U.S. Cl. ..... 105/364; 105/362; 105/176; 410/45; 410/49; 414/589

[58] Field of Search ..... 104/246; 105/160.5, 105/161, 358, 362 X, 364, 176 X; 410/42, 45 X, 47, 49 X, 53; 414/589 X, 910, 911, 745.4, 745.7, 745.8; 405/154, 174

[56] References Cited

U.S. PATENT DOCUMENTS

| | | | |
|---|---|---|---|
| 3,071,269 | 1/1963 | Moulds, Jr. | 410/49 X |
| 3,707,125 | 12/1972 | Milenkovic et al. | 104/246 X |
| 4,068,488 | 1/1978 | Ball | 405/154 X |
| 4,253,792 | 3/1981 | Nishikawa | 414/589 |
| 4,461,455 | 7/1984 | Mills et al. | 414/589 X |
| 4,854,806 | 8/1989 | Gertsch et al. | 414/589 X |
| 5,009,563 | 4/1991 | Case et al. | 410/49 X |

FOREIGN PATENT DOCUMENTS

| | | | |
|---|---|---|---|
| 251115 | 11/1987 | Germany | 414/589 |
| 751684 | 7/1980 | U.S.S.R. | 410/45 |

*Primary Examiner*—S. Joseph Morano
*Attorney, Agent, or Firm*—E. H. Oldham

[57] ABSTRACT

An apparatus specifically tailored to transporting pipes in a tunnel is disclosed. A pair of low slung bogies are used to support and transport a pipe to pipe junction location. The bogies move over a pair of rails on rollers. The pipe rests on a set of inflatable devices which may be selectively inflated in a controlled manner to move the pipe in two axes during transport to the junction site. At the junction site, the inflatable devices are used to "jockey" the pipe on the transport device to provide limited roll, pitch and yaw movement of the pipe to facilitate mating the transported pipe with the end of a previously set pipe string.

4 Claims, 2 Drawing Sheets

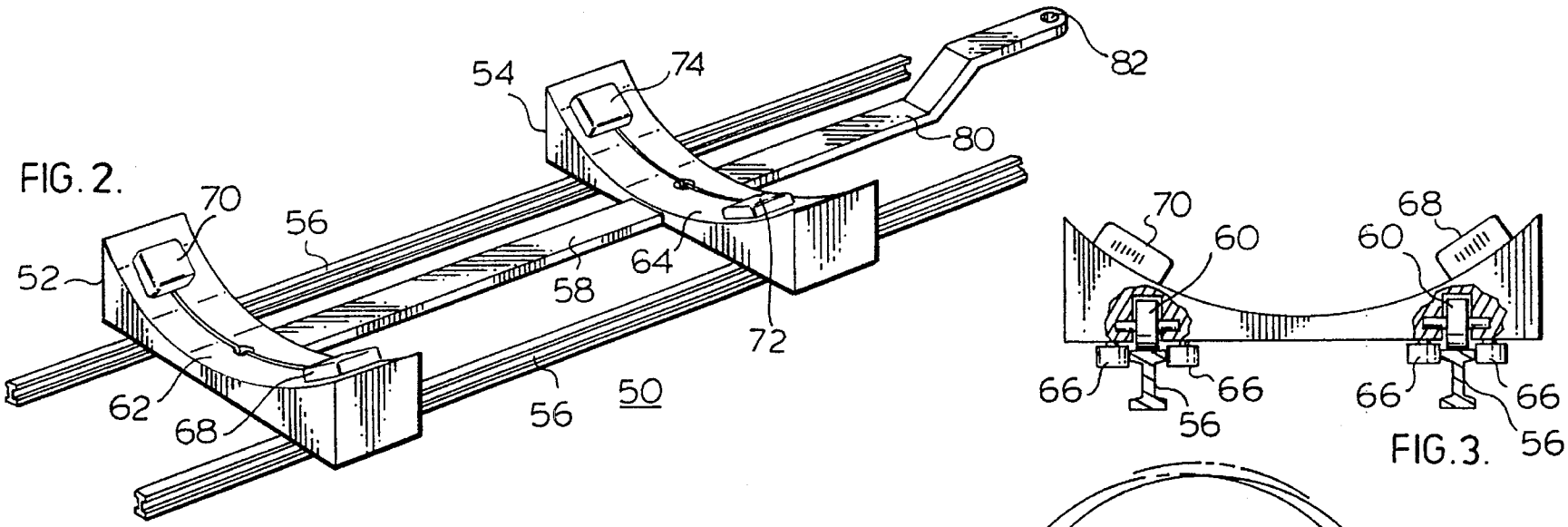
FIG. 2.
FIG. 3.
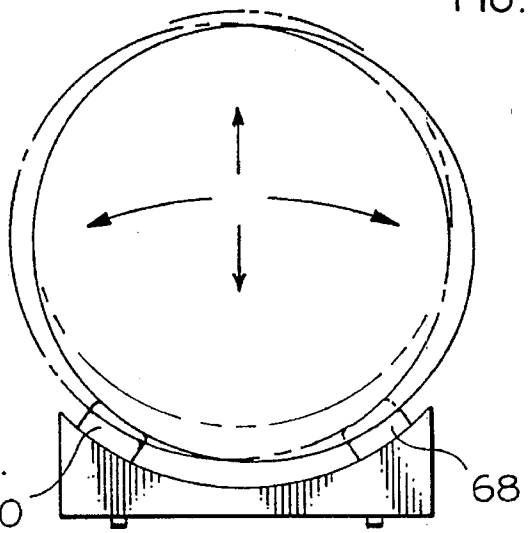
FIG. 5.
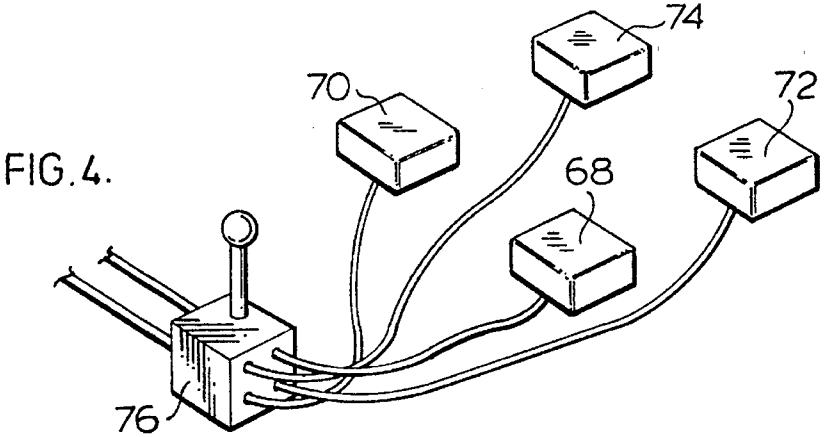
FIG. 4.

TRANSPORTATION AND INSTALLATION DEVICE FOR HEAVY PIPES

This invention relates to a machine for transporting a pipe in a tunnel (or other work location having restricted access) where a pipe must be carried from a loading site at one end of the tunnel to a location where the pipe undergoing transport will eventually be placed at the end of a string of similarly connected pipes in the tunnel.

The invention comprises a specially adapted transport car which is constructed to ride on a pair of rails and occupy a minimum height, on which a pipe may be loaded and carded so that the pipe may be delivered to a job site from the loading site.

By using small roller wheels (cam followers) and a low slung bolster assemblies, the resulting car is able to carry the load at a minimum height above the rails.

In order to "jockey" the pipe being carried by the transport car, a pair of airbags are installed on each end of the car.

By a suitable valving system, the airbags may be selectively inflated (or deflated) to lift or lower the entire pipe, or one end or one side of the pipe at a time.

In tunnels or other work locations having limited clearance between the pipe and the surrounding enclosure walls, it is most advantageous to be able to maneuver the pipe around on the carrying device to accommodate irregularities in the tunnel. It is even more necessary to be able to "jockey" the newly arrived pipe in at least two dimensions so as to mate the forward end of the new pipe to the pipes already laid. The use of the airbags greatly simplifies this operation as compared to the same operation with prior art devices.

PRIOR ART

CONCRETE PRESSURE PIPE DIGEST, Volume 23, Number 3 July–August, 1993

The prior art machine used in transporting pipes from the drop shaft to the end of the pipe string of previously laid pipes is shown in FIG. 1.

SUMMARY OF THE INVENTION

This invention comprises at least one low slung bogie which rides on a pair of tunnel tracks and is constrained to stay on the tracks by guide rollers mounted on the bogie. The bogie has a curved bolster for receiving a pipe (generally concrete) in the depression in the bolster so that the lowermost point of the pipe (generally located midway between the ends of the bolster and only slightly above the axes of the load bearing rollers of the bogie) rests well below the outside edges of each bolster. For some applications, the transport car will comprise a single bogie, but for purposes of this application, a car comprising a pair of bogies connected together will be described in the following description.

The bolster of each bogie has a pair of inflatable bags located outboard from the center of the bolster, which bags when inflated are capable of raising or lowering the pipe a distance of about ten inches, to cause substantial movement of the pipe on each bolster during transit. Irregularities in the tunnel or track apparatus can cause the pipe being carried to contact the tunnel sidewalls and the ability to "nudge" the pipe with the inflatable airbags during transit is a definite asset.

It is expedient to be able to "jockey" the pipe into position in a very accurate manner when fitting the newly arrived pipe to an existing pipe string to prevent damage to the pipe joint undergoing connection.

It is to be noted that the pipe is carried on a pair of bolsters, the upper surface of which is concave to allow the pipe to be "nested" in the concave curvature of the bolsters, the weight of the pipe is taken by the four airbags mounted near the outside edge of each bolster.

Because the inflation of the airbags may be conveniently controlled by a control lever, the pipe may be made to translate in the vertical direction by simultaneous inflation or deflation of all the airbags. It is easy to see that the pipe being carried may be tilted to produce a change in "pitch" along the longitudinal axis of the pipe if, say, either the forward or rear airbags are inflated or deflated separately.

The pipe may be made to execute limited movement in the yaw and roll axis by selective inflation and deflation of the airbags.

The pipe motion described above is a most welcome departure from the limited degrees of freedom provided by the prior art transport devices. Because of the degrees of freedom provided by the instant apparatus which will permit the pipe to be tilted, or moved laterally, a newly arrived pipe at the end of previously jointed pipe string, may be precisely positioned to join with the last installed pipe of the set pipe string. This is important when pipes of substantial mass are to be connected in limited space. Damage to the mating pipe flanges is not permissible.

Because the transport device carries the pipe on airbags which are filled with a compressible fluid, the position of the pipe is not "rigid" but yieldably compliant. This is of utmost importance during a pipe joining operation, because the pipe end being joined to the previously set pipe string may be pried or levered into position by the installation crew to move the pipe end an incremental distance against the airbag pressure to facilitate joining.

Blocks are usually inserted around the exposed end of the newly jointed pipe and as soon as the exposed pipe end is secured by blocking, the airbags are deflated and the transport device may be pulled out from under the blocked pipe for removal to the pipe loading site.

The use of this pipe transporting device has another distinct advantage that is not entirely obvious to the uninitiated. When using the pipe transporting device of the prior art, it will be immediately apparent that a pipe which is being installed must be lowered down the down shaft and then turned through 90° to be in a horizontal orientation. The pipe is now located so as to lie parallel to and between the tunnel tracks. The locomotive and the pipe carrying device of the prior art are now advanced from the location in the tunnel on the opposite side of the main tunnel (generally referred to as a tail tunnel) so that the pipe carrying device is threaded through the previously dropped pipe until the end of the pipe carrying device emerges from the pipe. At this point, the prior art device is raised inside the pipe until the pipe is lifted off its support (which support may be the tunnel tracks themselves). The tail tunnel must be of a length sufficient to accommodate the locomotive and the prior art pipe carrying device.

Using the device of this invention, the dropped pipe is rotated through 90° at the bottom of the drop shaft and dropped directly on the pipe carrying car. The tail tunnel required for the stowage of the equipment of this invention may be substantially reduced in length as well as cost because only the locomotive must be stowed in the tail tunnel during the pipe dropping and loading operation. The tail tunnel may be shortened by an amount equal to the length of the prior art pipe carrying apparatus which length is slightly longer than the length of the pipe being installed in the tunnel.

Of course if the down shaft is in the form of an open cut, the length of the cut is substantially reduced when using the apparatus of this invention. The shortening of the loading area has a distinct advantage if the open cut is located in a heavily populated area.

The tail tunnel shortening is also welcomed by the tunnelling fraternity because although comparatively short in length, it must be often dug by expensive manual means, and as it often serves no additional purpose, the tail tunnel must be filled in at the completion of the tunnelling project.

BRIEF DESCRIPTION OF DRAWINGS

FIG. 2 shows the device of this invention.

FIG. 3 is a plan view of one of the devices of FIG. 1 showing partial sections at the device.

FIG. 4 is a representation of the pneumatic control system.

FIG. 5 is an illustration of the possible motion of a pipe on the transporting device.

DESCRIPTION OF THE PREFERRED EMBODIMENTS

Figure 1:
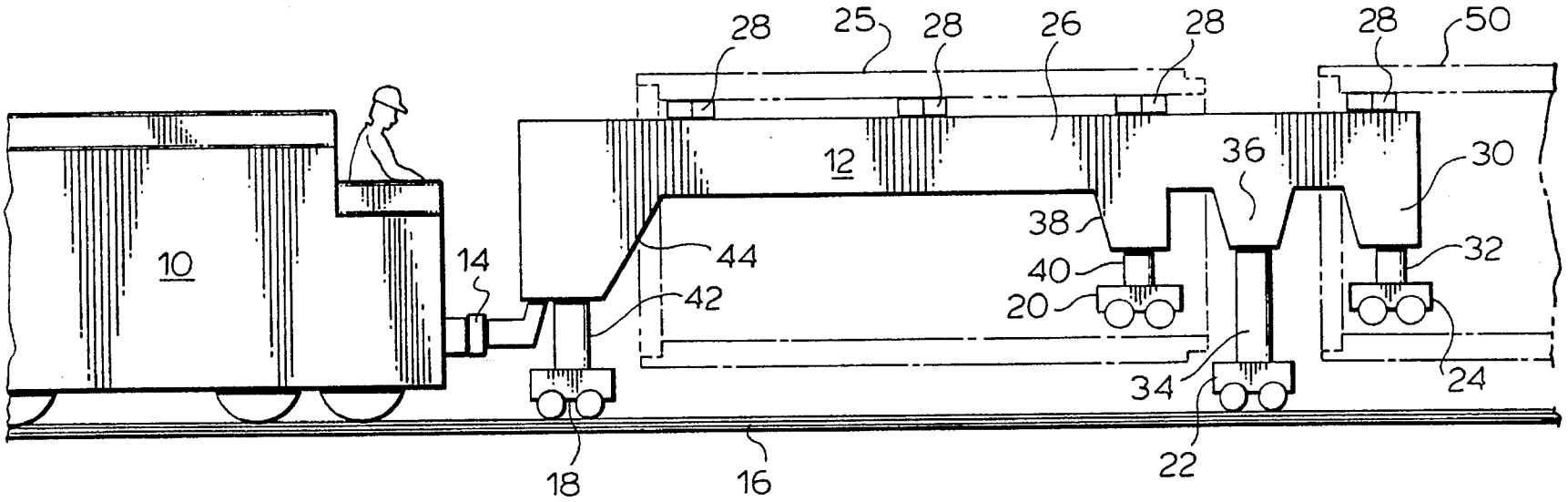
FIG. 1. (PRIOR ART)
FIG. 1 shows a prior art pipe transporting device.

Referring now to the drawings, FIG. 1 shows a view of a prior art device used for transporting pipes through a tunnel to a desired destination.

A locomotive 10 and a pipe transporting apparatus 12 are connected together by a junction device 14 are designed to move together on tunnel tracks 16.

Transporting device 12 has four sets of bogies 18, 20, 22 and 24 extending from boom 26 which has a plurality of pipe supports 28 for carrying a pipe 25 (shown in phantom) on the top of boom 26.

Device 12 functions as follows:

A pipe 25 is lowered into the shaft just ahead of device 12. Locomotive 10 pushes the device 12 toward the pipe with bogies 18 and 22 engaging track 16. Pedestal 30 is pushed inside the pipe and is subsequently activated to lower post 32 so that bogie 24 rides on the lower surface of the pipe. At this time, post 34 is raised into pedestal 36 so that the boom may now be advanced through the lowered pipe. As the boom passes into the pipe, bogies 20 and 24 carry the boom 12 through the pipe. As the boom passes through the pipe, pedestal 30 emerges from the opposite end and the boom is now carried on bogie 20 in pedestal 38. Boom 26 continues to move through the pipe until pedestal 36 with post 34 extends beyond the end of the pipe. At this time, post 34 is lowered and bogie 22 contacts the rails and the post 34 is extended until the boom pipe supports 28 contact the inside of the pipe 25.

Posts 42 and 34 are lowered until the pipe 25 is lifted and the locomotive is now able to push the transport apparatus with its mounted pipe along the rails 16 to the location where the pipe is to be joined to an existing string. At this time, both pedestals 30 and 36 protrude beyond the end of the pipe 25.

When the end 50 of pipe string is reached, pedestal 30 is inserted into the pipe end 50 and bogies 24 are lowered by lowering post 32 in pedestal 30 to contact the interior lower surface on the inside of the pipe 50 which is the end of the pipe last laid in the tunnel. Sufficient downward force on bogie 24 will pickup the pipe load and now post 34 may be raised to allow the pipe 25 to advance toward the end 50 of the last pipe of the existing string, with bogies 24 and 18 carrying the pipe.

Bogie 24 rolls along the inside of the end 50 of the last laid pipe until the pipe 25 is in position to be fitted into pipe end 50. At this time, the two posts 32 and 42 are manipulated to raise and lower the end of the pipe 25 remote from the locomotive 10 to facilitate fitting the pipe 25 over the end 50 of the pipe string. It is difficult to provide lateral motion of the pipe with this apparatus.

When the pipe 25 is fitted over the existing end 50, and the freshly transported pipe 25 is secured in this position, the transporting device 12 is retracted with bogies 18 and 24 carrying the pipe carrying device. 12. As soon as pedestal 36 emerges from pipe 25, the post 34 is lowered to contact rails 16 and pick up the weight of the boom 12. Post 32 is then raised and device 12 may be taken to the end of the tunnel to be loaded with another pipe.

The process of "threading" the transport device into a pipe to be transported is a time consuming, precision type operation requiring considerable operator dexterity. Mating the transported pipe with the end pipe of an existing pipe string is an even more challenging exercise in manual dexterity because maneuvering a long heavy massive article in a confined space, which at times requires lateral motion to accomplish mating can be most difficult. The shaft opening where the pipe is lowered to be in front of the transport apparatus requires considerable length because apparatus 12 must be longer than the pipe being transported, thus, the access shaft must be substantially longer than the length of the locomotive 10 and the transport apparatus 12, and the pipe 25.

Referring to FIG. 2, a pipe carrying car 50 is shown comprising two low slung bogies 52 and 54 mounted on rails 56 and connected by a "reach" 58. Bogies 52 and 54 ride the rails 16 by means of a pair of cam followers 60 (see FIG. 3) at each end of the laterally extending bolster surfaces 62 and 64 on which a pipe is to be carried. Roller guides 66 extend downwardly on each side of the rail 56 to keep the bogies on the tracks 56. Each bogie has 4 load carrying rollers 60 to carry the pipe to be loaded on bolster surfaces 62 and 64.

Mounted on opposite sides of the bolster surfaces 62 and 64 are a pair of pneumatic jacking pads 68, 70 and 72 and 74 are connected to a three way valve in the system shown in FIG. 4. With the valve 76 in place, it is possible to inflate both jacking devices 68 and 70 simultaneously, or deflate simultaneously, or inflate device 68 whilst deflating device 70.

The system functions as follows:

Locomotive 10 is coupled, in this instance, by push bar 80 to the bogie 52 to enable the locomotive to move the transport device along tracks 56. For loading, the locomotive pulls the transport device 10 into the access shaft opening for loading a pipe onto bolster surfaces 62 and 64 of bogies 52 and 54. With devices 68, 70, 72 and 74 deflated, a pipe is placed on the device 10. Locomotive 10 is now able to push the transport device into the tunnel toward the last pipe of the pipe string. The valve member 76 may be used to position the pipe laterally on the transport device in places where side clearances are limited by tunnel irregularities or track placement. When the pipe string is reached, the pipe is easily jockied into position using the valve 76 to inflate or deflate the devices 68, 70, 72 and 74. The pipe may be conveniently maneuvered on the device 10 until a precise line up occurs and the locomotive may be used to push the pipe home. With the newly transported pipe blocked in its final position, the devices 68, 70, 72 and 74 are now deflated and transport device 10 may be withdrawn to return to the loading site to receive another pipe.

The device 10 is a versatile transport assembly with the ability to load, carry and discharge a pipe in a swirl convenient manner hitherto unknown. The prior art apparatus is slow, heavy and unwieldy and requires substantial time and space to function. In locations where space is limited, the prior art apparatus requires a much larger access shaft in order to be able to operate.

The apparatus of this invention is basically a simplified apparatus whose cost is substantially reduced over the prior art apparatus, and the use is basically simplified and mechanically simple. First costs and maintenance costs are substantially reduced.

For purposes of this invention, the devices 68, 70, 72 and 74 are preferably high pressure airbags, sold under the trademark MAT JACK. Of course, other pneumatic and hydraulic devices will accomplish the same end result, but the inflatable mats are easy to use and extremely rugged. The environment in which this apparatus must function is extremely hostile and successful operation requires robust, rugged apparatus.

Pipe sections approximately twenty feet long and of an outside diameter of approximately eight feet which weigh approximately twenty-five tons may be conveniently transported on the apparatus described herein.

Each bogie has a pipe receiving area of approximately two feet by three and a third feet with a concave drop in the bolster surface of approximately 4 inches for the above described apparatus.

It will be obvious that the transport device of this invention may take many forms. A double bogie device has been described herein, but a car comprising a single bogie with the wheels or rollers spaced apart so as to be at remote ends of the car will function equally well. Rollers have been illustrated for transporting the car but other forms of support such as air cushion or magnetic levitation may be appropriate in situations where restricted operating space will permit such operation, a sled may well provide support for transport.

The use of the airbags on the transport car provides a convenient method of carrying a pipe (or other massive article) in a restricted space where the article must be moved around on the transport apparatus to avoid contact with the confining enclosure.

The use of the airbags for jockeying the pipe at the site where the pipe is to be joined to the end of an existing pipe string that the advantageous effect of the selectively controllable inflatable airbags may be experienced. It is important to provide a resistively compliant type of mounting so that prying and levering of the transported pipe may be effective during critical mating procedure to provide incremental movement of the pipe being mated. In this instance, pneumatic apparatus has been chosen, but the use of a hydraulic system having a gas cushion device to provide the necessary compliance of the relatively incompressible fluid may function equally well.

It will be found that the ratio of pipe lengths to the length of the device 50 should be about 2:1 to permit ease of maneuvering of the pipe during a mating operation, however this ratio is not critical.

We claim:

1. A transport device for transporting a pipe along a track in a confined space from a loading site to the end of a previously set string of pipes to which the transported pipe is to be jointed comprising:

a low slung vehicle suitable for movement on said track, comprising a pair of bogies, suitably joined together in predetermined spaced relationship, each bogie having a concave supporting surface for receiving said pipe therein, each supporting surface having a pair of inflatable air bags, each mounted near the outside edge of the supporting surface for contacting said pipe.

2. The transport device of claim 1 wherein each bogie of the pair is equipped with at least two load bearing rollers for engagement with said track, each bogie also being provided with guide rollers to keep the vehicle on said track.

3. The transport device of claim 2 wherein a push bar is provided to propel the vehicle along the track.

4. A method of transporting a pipe in a tunnel where the pipe is only slightly smaller than the tunnel comprising:

providing a low slung vehicle having a pair of spaced apart bogies equipped with rollers and inflatable air bags, said rollers being suitable for rolling on a track in said tunnel, mounting said airbags on said bogies outboard of said rollers so as to directly contact and support the pipe, so that upon .minimum pressure in said air bags, the lowest surface of said pipe is at a height only slightly above the axes of said rollers of said bogies, activating a control means to selectively adjust the inflation of each airbag to move the pipe in roll pitch and yaw axes.

* * * * *